US009410414B2

(12) United States Patent
Tudor

(10) Patent No.: US 9,410,414 B2
(45) Date of Patent: Aug. 9, 2016

(54) ENVIRONMENTALLY SEALED SYSTEM FOR FRACTURING SUBTERRANEAN FORMATIONS

(71) Applicant: Robin Tudor, Black Diamond (CA)

(72) Inventor: Robin Tudor, Black Diamond (CA)

( * ) Notice: Subject to any disclaimer, the term of this patent is extended or adjusted under 35 U.S.C. 154(b) by 465 days.

(21) Appl. No.: 14/060,416

(22) Filed: Oct. 22, 2013

(65) Prior Publication Data

US 2015/0107822 A1 Apr. 23, 2015

(51) Int. Cl.
*E21B 43/267* (2006.01)

(52) U.S. Cl.
CPC ..... *E21B 43/267* (2013.01)

(58) Field of Classification Search
CPC ..... E21B 43/267
See application file for complete search history.

(56) References Cited

U.S. PATENT DOCUMENTS 8,276,659 B2 10/2012 Fordyce et al.
8,408,289 B2 4/2013 Loree
2006/0231254 A1 10/2006 Peskunowicz et al.
2010/0027371 A1 2/2010 Lucas et al.
2010/0155066 A1 6/2010 Fordyce
2012/0247776 A1 10/2012 Leshchyshyn et al.
2015/0086307 A1* 3/2015 Stefan ..... B65D 88/005 414/304
2016/0045841 A1* 2/2016 Kaplan ..... B01J 19/0093 429/49

* cited by examiner

*Primary Examiner* — William P Neuder
(74) *Attorney, Agent, or Firm* — Maxey Law Offices, PLLC; Stephen Lewellyn

(57) ABSTRACT

An environmentally sealed system for fracturing subterranean systems including a fracturing fluid source, a proppant source, a proppant hopper comprising a variable proppant regulator, a blender comprising a blender inlet and a blender outlet, a high pressure pump comprising a high pressure pump inlet and a high pressure pump outlet, and a well head; wherein the fracturing fluid source is connected to the blender inlet through a fracturing fluid supply connection and a fracturing vapor recovery connection, the proppant source is connected with the proppant hopper through a proppant supply connection and a proppant vapor recovery connection, the proppant hopper is connected to the blender inlet through a proppant transfer connection, the blender outlet is connected to the high pressure pump inlet, and the high pressure pump is outlet connected to the well head.

19 Claims, 8 Drawing Sheets

ENVIRONMENTALLY SEALED SYSTEM FOR FRACTURING SUBTERRANEAN FORMATIONS

FIELD OF THE INVENTION

The present invention relates generally to systems for fracturing subterranean formations, and more particularly, relating to environmentally sealed systems for fracturing subterranean formations.

BACKGROUND OF THE INVENTION

Hydraulic fracturing of subterranean formations, also called fracking, is well known. Hydraulic fracturing is a process that uses high pressure fracturing fluid that is pumped into a well to cause the rock formation of the well to separate apart, or fracture, creating pockets within the rock formation. Hydraulic fracturing allows production of oil and gas from areas where other well completion technologies are limited or not possible.

Generally a fracturing fluid is mixed with a proppant and then pumped into a well to create high pressures within the well. After the cracks develop in the rock formations due to the high pressure, the proppant flows into the crack and lodges in place. The proppant stops the crack from closing once the high pressure is released.

The fracturing fluids used in hydraulic fracturing represent varying levels of volatility. Volatility is classified by the vapor pressure and flash point of the fluid. Typically, fluids with a vapor pressure less than 2 pounds per square inch ("psi") at 100° F. and a flash point greater than 10° F. above ambient temperatures are considered to be non-volatile. Non-volatile fracturing fluids may be open to the environment and therefore may be blended with proppant at a continuous rate through the use of open blenders. Examples of non-volatile fluids include water, low vapor pressure hydrocarbons, and methanol/water mixtures. Volatile fracturing fluids, however, must be processed in an environmentally sealed blender. Environmentally sealed, as used in this context, means that the processing equipment is sufficiently sealed to prevent leakage of gases and particulates from within the processing equipment under normal operating pressures of the equipment.

Until now the only environmentally sealed mixers available were enclosed mixers that only allow for batch processing of fracturing fluid and proppant rather than continuous processing of these materials. Examples of volatile fluids which must be processed in environmentally sealed equipment include liquid carbon dioxide and liquid petroleum gases such as propane or butane.

While non-volatile fracturing fluids are much easier to work with, due to the ability to continuously process the fracturing fluid and proppant in an open blender, a number of additional fluid characteristics must be taken into account which may make the use of volatile fluids more desirable. These characteristics include density, viscosity, vapor pressure, flash point, pH, surface tension, compatibility with formation, reservoir fluid, and cost. FIG. 1 shows relative costs of several common fracturing fluids. FIG. 2 shows relative safety risks of several common fracturing fluids. And FIG. 3 shows relative environment impact risks of several common fracturing fluids.

While the devices heretofore fulfill their respective, particular objectives and requirements, they do not provide an environmentally sealed system for fracturing subterranean formations as such there exists and need for a system for fracturing subterranean formations, which substantially departs from the prior art, and in doing so provides an apparatus primarily developed for the purpose of fracturing subterranean formations in a manner that allows continuous blending and pumping of fracturing fluid and proppant in a manner that is sealed from the environment.

SUMMARY OF THE INVENTION

In view of the foregoing disadvantages inherent in the known types of systems for fracturing subterranean formations including hydraulic fracturing systems now present in the prior art, the present invention provides a new environmentally sealed system for fracturing subterranean formations.

In general, in one aspect, an environmentally sealed apparatus for fracturing subterranean systems is provided. The apparatus for fracturing subterranean systems includes an environmentally sealed proppant hopper comprising a variable proppant regulator, an environmentally sealed blender comprising a blender inlet and a blender outlet, and a high pressure pump comprising a high pressure pump inlet and a high pressure pump outlet; wherein the blender inlet comprises a fracturing fluid inlet, a fracturing vapor outlet, a proppant inlet, and a proppant vapor outlet; the environmentally sealed proppant hopper is connected to the blender inlet through a proppant transfer connection; and the blender outlet is fluidically connected to the high pressure pump inlet.

In general, in another aspect, an environmentally sealed system for fracturing subterranean systems is provided. The system for fracturing subterranean systems includes an environmentally sealed fracturing fluid source, an environmentally sealed proppant source, an environmentally sealed proppant hopper comprising a variable proppant regulator, an environmentally sealed blender comprising a blender inlet and a blender outlet, a high pressure pump comprising a high pressure pump inlet and a high pressure pump outlet, and a well head; wherein the environmentally sealed fracturing fluid source is fluidically connected to the blender inlet through a fracturing fluid supply connection and a fracturing vapor recovery connection, the environmentally sealed proppant source is connected in a flow relationship with the environmentally sealed proppant hopper through a proppant supply connection and a proppant vapor recovery connection, the environmentally sealed proppant hopper is connected to the blender inlet through a proppant transfer connection, the blender outlet is fluidically connected to the high pressure pump inlet, and the high pressure pump is outlet fluidically connected to the well head.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
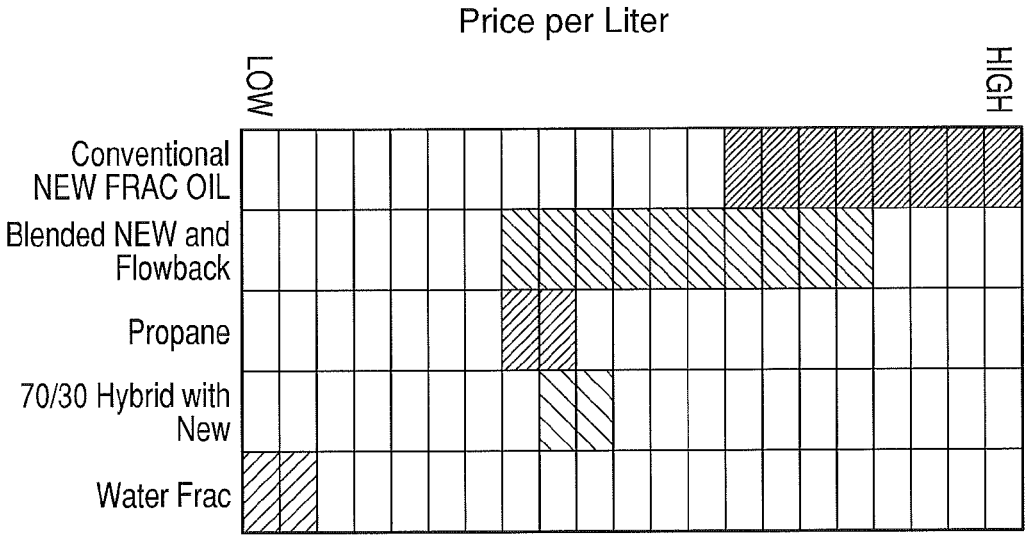
FIG. 1 is a table showing the relative fluid costs for different types of fracturing fluids.
Figure 2:
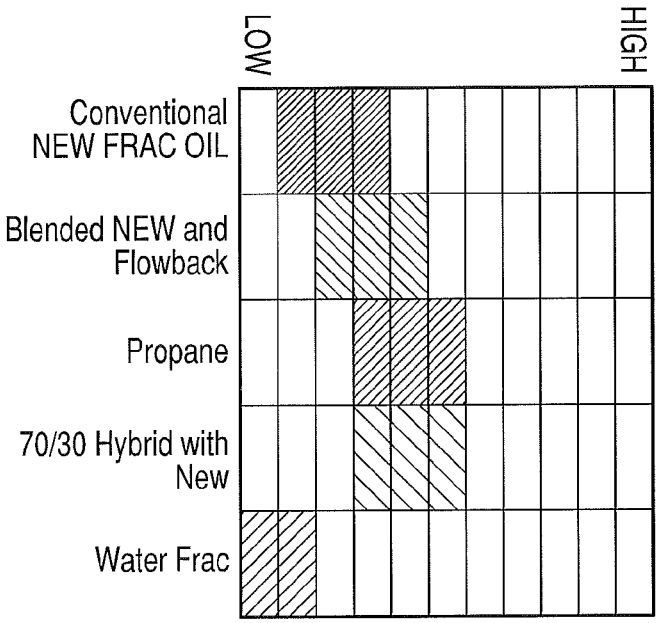
FIG. 2 is a table showing the relative safety risk for different types of fracturing fluids.
Figure 3:
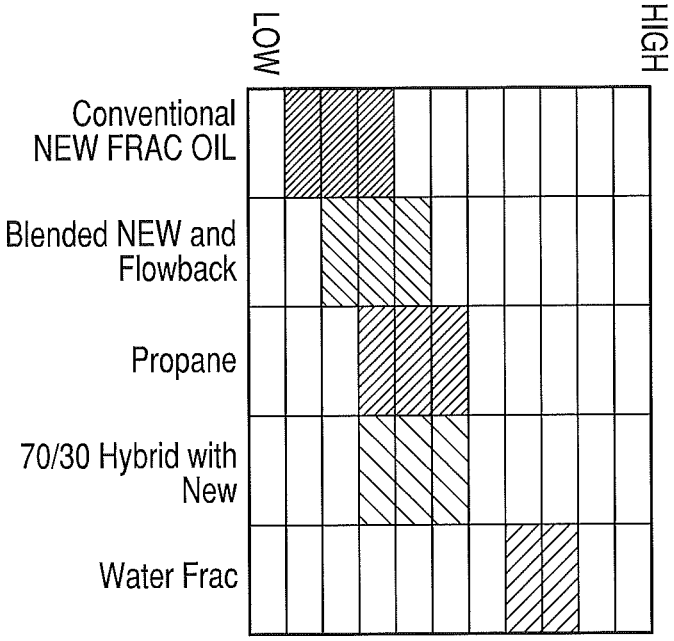
FIG. 3 is a table showing the relative environmental impact for different types of fracturing fluids.
Figure 4:
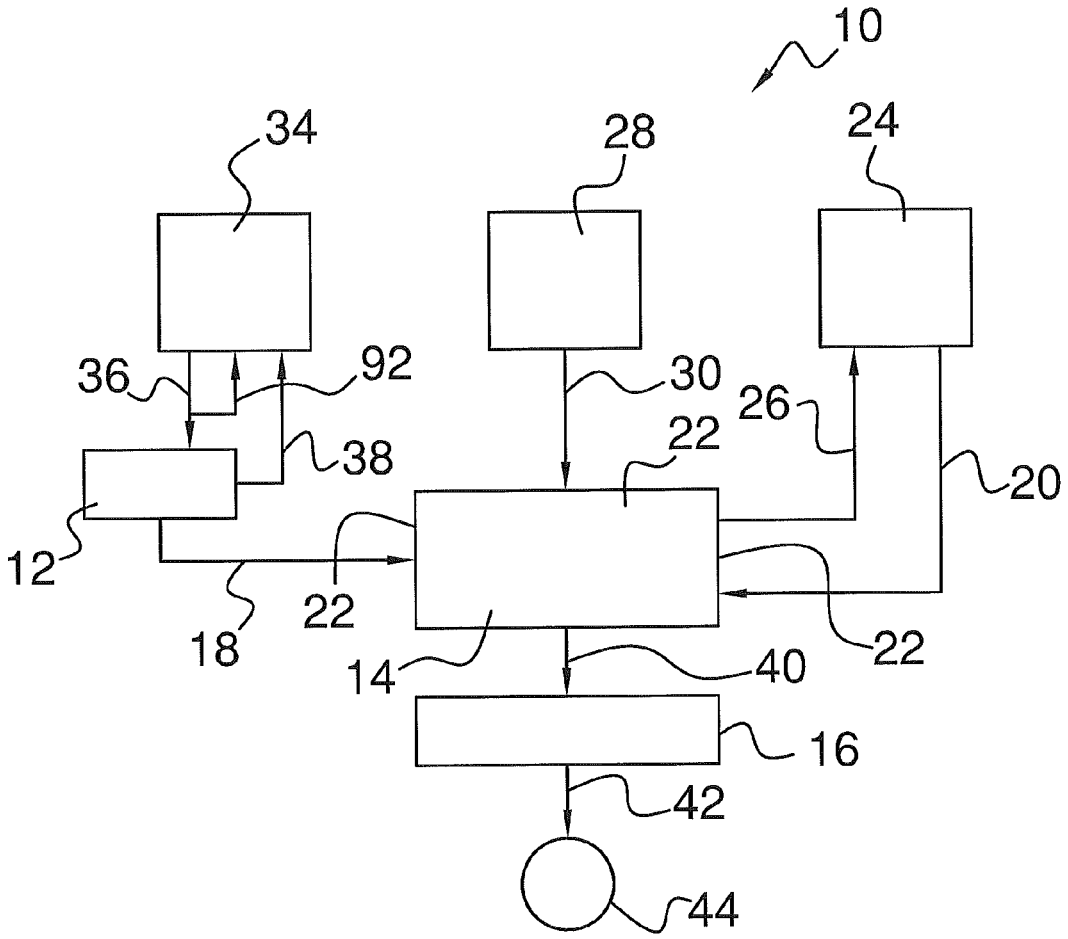
FIG. 4 is a schematic view of the environmentally sealed system for fracturing subterranean systems constructed in accordance with the principles of the present invention.

With reference to FIGS. 4 through 9, there is illustrated a new environmentally sealed apparatus and system for fracturing subterranean systems 10 in accordance with an embodiment of the present invention. The main components of the environmentally sealed apparatus 10 are a proppant hopper 12, a blender 14, and a high pressure pump 16. The proppant hopper 12 and the blender 14 are environmentally sealed. The proppant hopper 12 is connected to the blender 14 through a proppant transfer connection 18. The proppant transfer connection 18 is also environmentally sealed, and permits proppant to flow from the proppant hopper 12 to the blender 14.

Proppant is to be understood as any solid particulate material that may be suspended in fluid. Proppant may be either natural or synthetic. Proppants may also be coated with a resin to modify one or more characteristics of the proppant. Commonly used proppants include sand, ceramics, bauxites, and other specialty compositions.

The blender mixes the proppant with a fracturing fluid that is supplied to the inlet of the blender through a fracturing fluid supply connection 20. Typical fracturing fluids include water; hydrocarbon fluids, such as diesels, kerosenes, condensates, and mineral oils; liquefied gases, such as carbon dioxide; liquefied petroleum gases, such as propane and butane; and combinations thereof. The fracturing fluid may include additives such as viscosity modifiers, friction modifiers, antibacterialcides, emulsifiers, demulsifiers, breakers, or any other additive known in the art.

The fracturing fluid supply connection 20 connects the inlet 22 of the blender 14 to a fracturing fluid source 24 in a manner that permits the fracturing fluid to flow from the fracturing fluid source 24 to the inlet 22 of the blender 14. The fracturing fluid source 24 will be chosen based on the type of fracturing fluid to be used. Fracturing fluid sources 24 may include one or more pressurized tanks, non-pressurized tanks, reservoirs, or any other fracturing fluid sources known in the art. Non-pressurized tanks may or may not be environmentally sealed.

Figure 5:
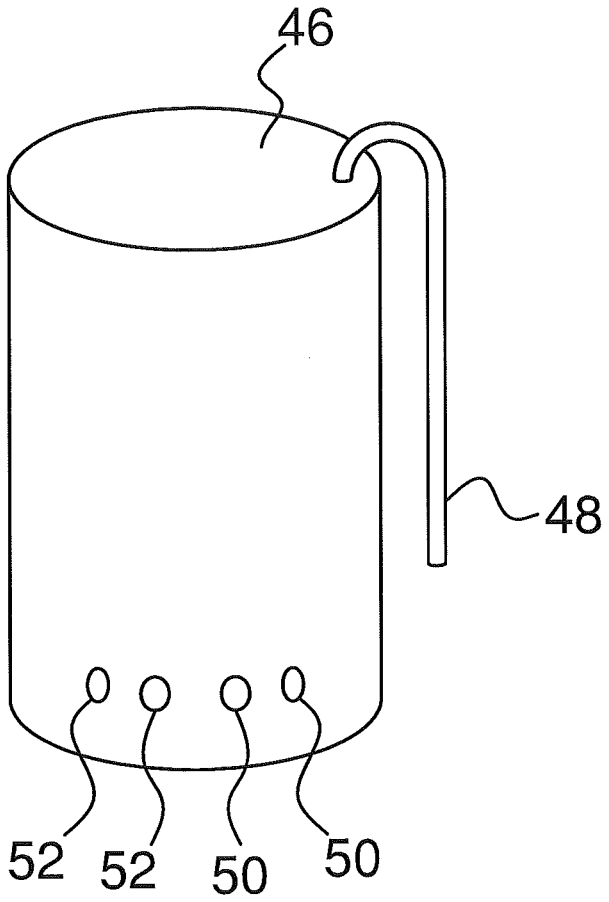
FIG. 5 is a schematic view of the environmentally sealed system for fracturing subterranean systems, showing or illustrating the combination with an additional system for fracturing subterranean systems.

FIG. 5 shows an exemplary non-pressurized tank 46 which is not environmentally sealed. The non-environmentally sealed tank 46 includes a vent tube 48 which allows excess gases and vapors to vent from the non-environmentally sealed tank 46. The tank may have one or more tank inlet valves 50 and one or more tank outlet valves 52.

Figure 6:
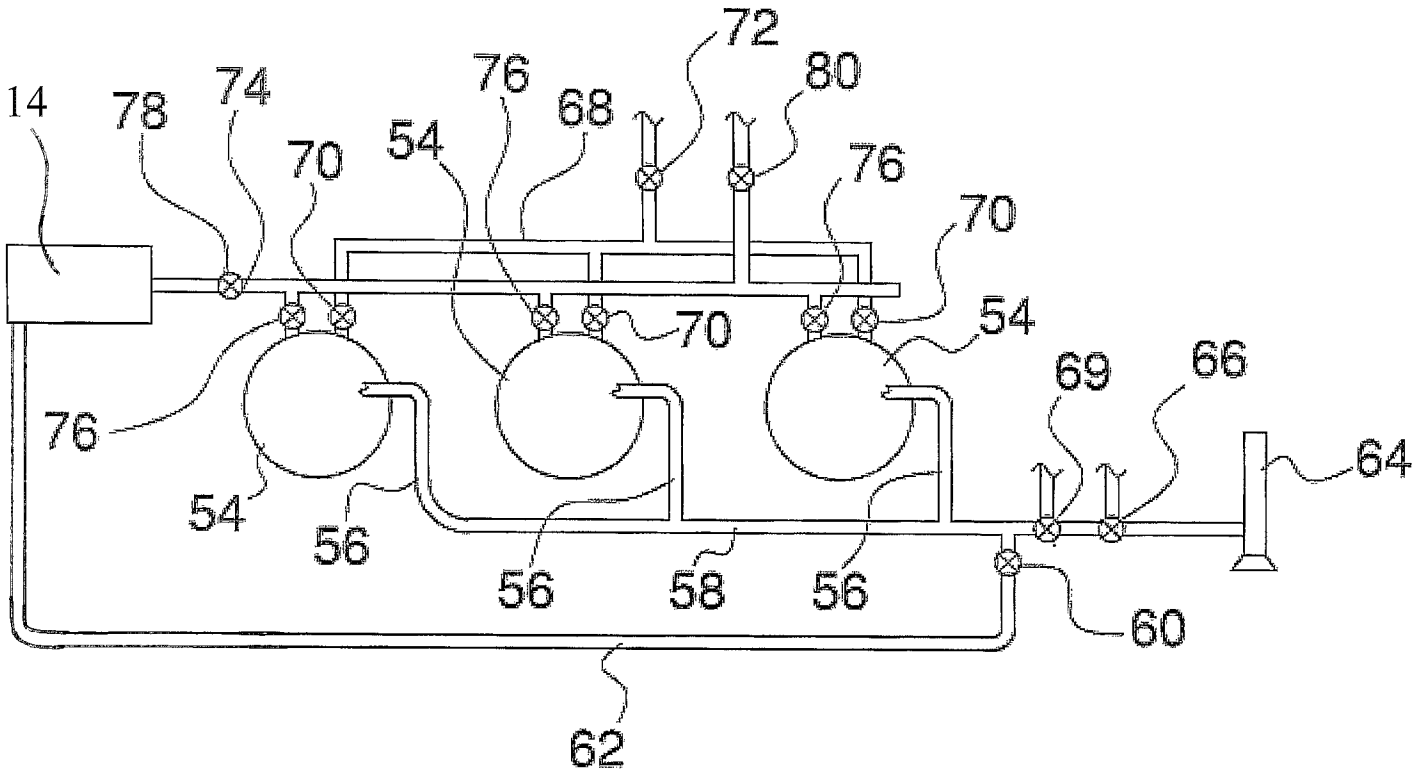
FIG. 6 is an isometric view of a conventional vented storage tank.

FIG. 6 shows exemplary environmentally sealed tanks 54. The environmentally sealed tanks 54 may be connected to one or more vent lines 56 that may be joined together thereby forming a vent manifold 58. The vent manifold 58 may be connected, via a vapor control valve 60, to a vapor return line 62. The flow of fracturing fluid from the environmentally sealed tanks 54 creates a reduced pressure within the environmentally sealed tanks 54 that assists in evacuating excess gases and vapors from the blender 14 through the one or more vent lines 56. The vapor control valve 60 may be a conventional valve or a one-way valve to prevent vapors from returning back through the vapor return line 62 and to the blender 14. The vent manifold 58 may also be connected to a flare 64 to permit flaring of vapor within the vent manifold 58. A purge valve 66 may be connected to control the flow of vapor from the vent manifold 58 to the flare 64.

The environmentally sealed tanks 54 may also be connected to an inlet manifold 68. The inlet manifold 68 may be connected to the environmentally sealed tanks 54 through inlet valves 70. The inlet manifold 68 may also be connected to a main inlet valve 72 to control flow to the inlet manifold 68. An external fracturing fluid source may be connected to the main inlet valve 72 for filling the environmentally sealed tanks 54. During the filling of the environmentally sealed tanks 54 the external fracturing fluid source may be connected to the vent manifold 58 by a filling vent valve 69. The filling vent valve 69 selectively permits or prevents flow of vapors from the vent manifold 58.

The environmentally sealed tanks 54 may also be connected to an outlet manifold 74. The outlet manifold 74 may be connected to the environmentally sealed tanks 54 through outlet valves 76. The outlet manifold 74 may also be connected to a main outlet valve 78 to control flow from the outlet manifold 68 to the blender 14. The outlet manifold 74 may further be connected to a secondary outlet valve 80 to control flow from the outlet manifold 74 during draining or transfer of the contents of the environmentally sealed tanks 54.

Embodiments utilizing environmentally sealed tanks 54 for a fracturing fluid source 24 will preferably be connected to a fracturing vapor outlet 26 which connects the inlet 22 of the blender 14 to the fracturing fluid source 24. The fracturing vapor outlet 26 allows any particles, vapors or gases within the blender 14 to be transferred to the fracturing fluid source 24. Allowing the particles, vapors, or gases within the blender 14 to be transferred to the fracturing fluid source 24 reduces pressure buildup in the blender 14.

In many instances it is beneficial to supply an additive to the fracturing fluid and proppant during the blending process. The additives may be viscosity modifiers, friction modifiers, antibacterialcides, emulsifiers, demulsifiers, breakers, or any other additive known in the art. In embodiments allowing for addition of additive to the fracturing fluid and proppant in the blender 14, an additive source 28 is connected to an additive inlet 30 connected to the inlet 22 or the outlet 40 of the blender 14.

The additive source 28 will be chosen based on the type of additive to be used. Additive sources 28 may include one or more pressurized tanks, non-pressurized tanks, reservoirs, or any other additive sources known in the art. Non-pressurized tanks may or may not be environmentally sealed.

In many embodiments the proppant hopper 12 is connected to a proppant source 34 through a proppant conveyance system 36 that is environmentally sealed. The proppant source 34 may be one or more unsealed containers, environmentally sealed containers, piles, pits, or any other proppant sources known in the art. Environmentally sealed containers may or may not be pressurized. The proppant source 34 will preferably be an environmentally sealed non-pressurized container.

Figure 7:
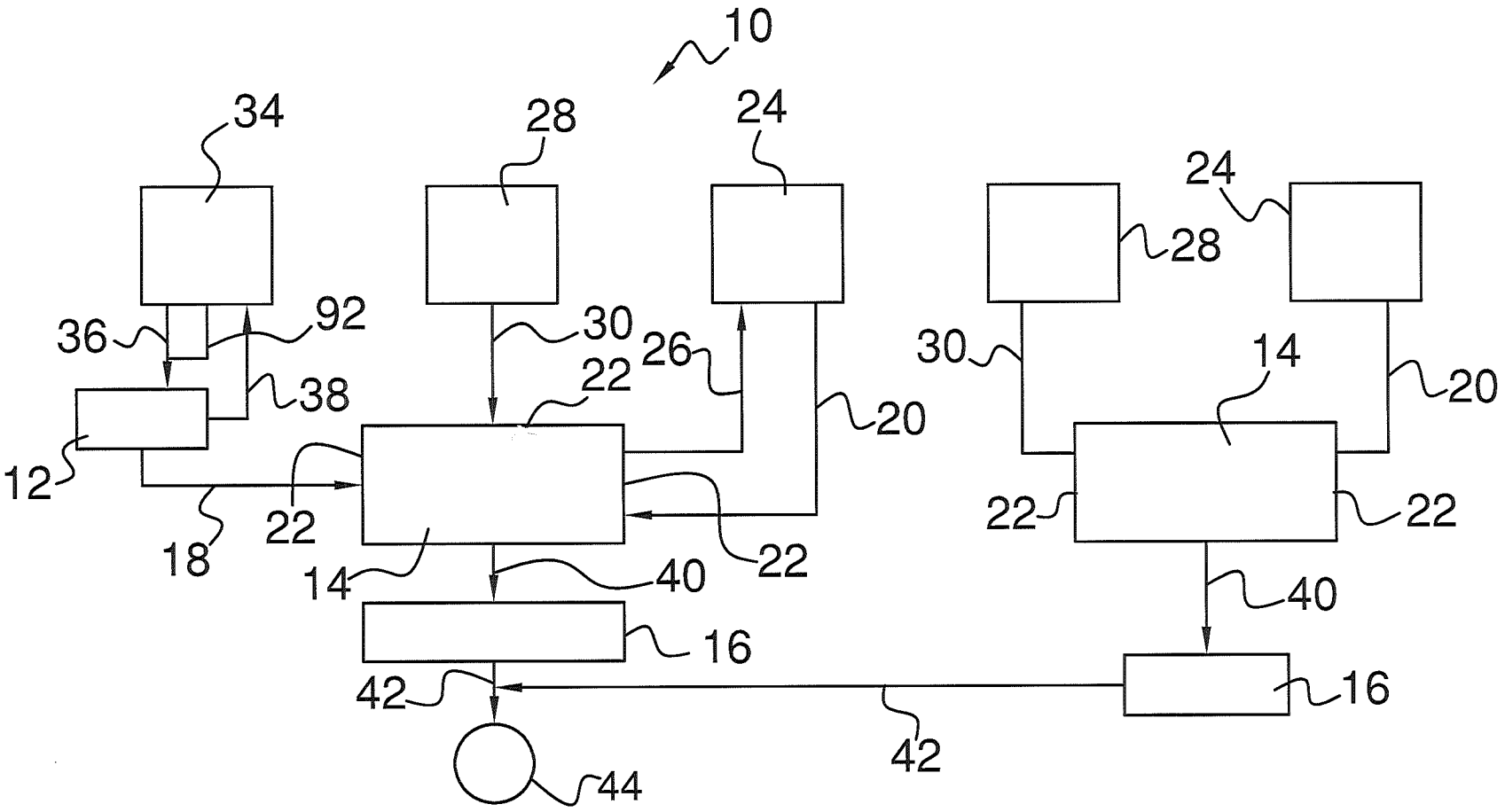
FIG. 7 is a schematic view of an environmentally sealed storage tank.

Once the proppant, fracturing fluid and optional additives are mixed together in the blender 14, the mixture is transferred through a blender outlet 40 to the high pressure pump 16. From the high pressure pump 16, the mixture is transferred through a high pressure pump outlet 42 to a well head 44. In some embodiments it may be beneficial for the output streams of two or more systems for fracturing subterranean systems, or parts thereof, to join together at some point prior to entering the well head. FIG. 7 schematically shows an embodiment of the present invention joined together with a conventional fracturing system between the high pressure pump 16 and the well head 44.

Figure 8:
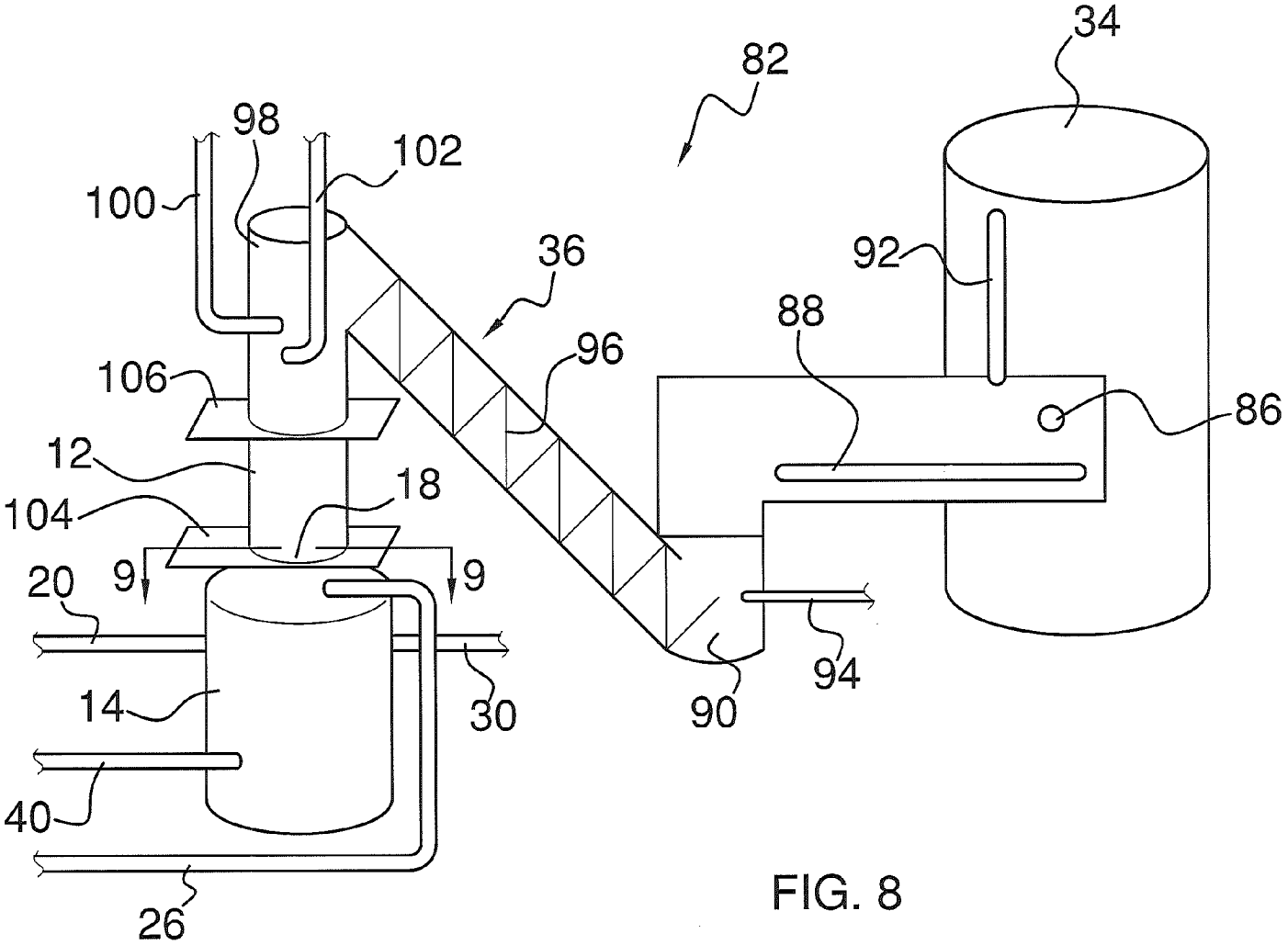
FIG. 8 is a side view of the environmentally sealed system for fracturing subterranean systems, illustrating the proppant delivery system.
Figure 9:
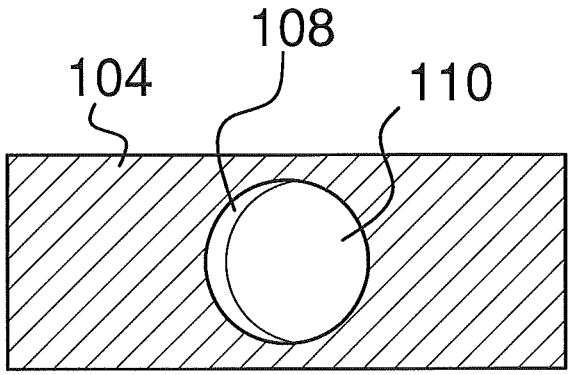
FIG. 9 is a cross-sectional view of the environmentally sealed proppant hopper, showing the variable proppant regulator.

Now with particular reference to FIGS. 8 and 9, the proppant deliver and mixing system 82 of the present invention will be described. The proppant is stored in the proppant source 34. The proppant is delivered from the proppant source 34 to the proppant conveyance system 36 through a proppant source outlet 86. The proppant may be carried by a proppant transfer 88 to an intermediate hopper 90. The proppant transfer 88 may be open or may be environmentally sealed. It is preferred that the proppant transfer 88 be environmentally sealed to contain dust particles from the proppant. The sealed proppant transfer 88 will be connected to a transfer vapor return 92 to return particles, dust and gases from the proppant transfer to the proppant source 34. The proppant hopper 12 may be connected to a hopper vapor return 38 to return particles, dust and gases from the proppant hopper 12 to the proppant source 34.

Once the proppant is in the intermediate hopper 90, an inert gas may be injected into the intermediate hopper 90 through the lower inert gas injection port 94. The inert gas functions to purge the proppant of air. The inert gas may be carbon dioxide, nitrogen, or any other suitable inert gas known in the art.

The proppant is raised to a level above the proppant hopper 12 by a proppant lift 96. The proppant lift 96 will preferably be an auger. At the upper section 98 of the proppant hopper 12, an inert gas may be injected through the upper inert gas injection port 100. The inert gas assists the proppant perform a sealing function for the proppant hopper 12. The inert gas may be carbon dioxide, nitrogen, or any other suitable inert gas known in the art.

Between the upper section 98 of the proppant hopper 12 and the proppant transfer connection 18, through which proppant enters the blender 14, the proppant hopper 12 includes a variable proppant regulator 104 and a hopper seal 106. The variable proppant regulator 104 is designed to allow adjustment to the amount of proppant flow. The variable proppant regulator will preferably be of a design which incorporates a regulating orifice 108 in the variable proppant regulator 104 which is movable relative to an exit orifice 110 of the hopper 12. The regulating orifice 108 will allow a maximum proppant flow when the regulating orifice 108 and the exit orifice 110 are aligned. Movement of the variable proppant regulator 104 relative to the exit orifice 110 results in a reduced overlap of the regulating orifice 108 and the exit orifice 110 thereby reducing the amount of proppant flow.

The variable proppant regulator 104 will preferably be continuously or incrementally adjustable between a maximum overlap of the regulating orifice 108 and the exit orifice 110, referred to as a fully open position, and no overlap of the regulating orifice 108 and the exit orifice 110, referred to as a closed position. The regulating orifice 108 will preferably provide a static seal between the hopper 12 and the blender 14 when in the closed position. The static seal provided by the regulating orifice 108 in the closed position seals proppant from entering the proppant transfer connection 18 from the hopper 12. The static seal provided by the regulating orifice 108 in the closed position also preferably seals particles, vapors, or gases from entering the proppant transfer connection 18 from the blender 14.

The hopper seal 106 will preferably be a solid door type of seal. The hopper seal is movable relative to the hopper 12 so that when the hopper seal 106 is in an open position there is substantially no overlap between hopper seal 106 and the flow passage for the proppant through the hopper 12. When the hopper seal 106 is in an closed position there is substantially full overlap between hopper seal 106 and the flow passage for the proppant through the hopper 12 thereby sealing particles, vapors, or gases from entering the upper section 98 of the proppant hopper 12. The hopper seal 106 may also be an overlapping orifice type of seal similar to the variable proppant regulator 104.

Figure 10:
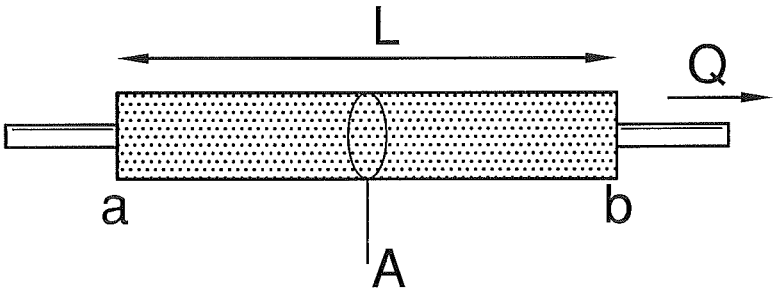
FIG. 10 is a schematic view of the system used for calculation of required proppant flow.

During operation of the blender 14, the flow of proppant through the proppant hopper 12 provides a pressure seal for the blender 14. The pressure seal is achieved by calculating the theoretical vapor flow through a proppant hopper 12 filled with proppant of the type being supplied to the blender 14 in a static condition and then ensuring that the velocity of the proppant through the proppant hopper 12 is greater than or equal to the calculated flow. Vapor flow through the proppant in a static condition can be calculated by the following formula:

$$q = \frac{-k}{\mu} \nabla P.$$

Where q is the flux meaning the discharge per unit area with units of length per time, μ is viscosity, k is the permeability of the medium and ∇ is the pressure gradient vector. Providing a per unit area value, the above formula is a derivation of the well know formula for calculation of the flow of a fluid through a porous medium known as Darcy's law and shown below:

$$Q = \frac{-kA}{\mu}\frac{(P_b - P_a)}{L}.$$

Where Q is the rate of flow, μ is viscosity, k is the permeability of the medium, A is the cross-sectional area of the porous medium, L is the length of the porous medium, $P_a$ is the Pressure at point a, and $P_b$ is the pressure at point b. The system for application of Darcy's law is shown in FIG. 10.

The mass flow rate of the proppant, $q_m$, through the hopper 12 may be calculated by the formula $$q_{mr} = q_{fs} \cdot C,$$

where $q_{fs}$ is the flow rate of the mixture through the outlet 40 of the blender 14 and C is the proppant flow rate into the inlet 22 of the blender 14. The volumetric flow rate of the proppant, $q_{vfr}$, through the hopper 12 may be calculated by the formula $$q_{vfr} = \frac{q_{mr}}{BD},$$

where BD is the bulk density of the proppant. The minimum cross sectional area of the proppant flow to equalize vapor flow from the blender 14 to the proppant flow into the blender 14 may be calculated by the formula $$A\phi_{min} = \frac{q_{vfr}}{q}.$$

The permeability is determined by the gas being examined and the proppant utilized. Proppant is graded by how it passes through a sieve. For example, a proppant labeled as 20/40 will pass through a sieve that has twenty openings per square inch would not pass through a sieve that has forty openings per square inch. The effective permeability can be changed by adding a fluid into the pores of the proppant. For this reason, the upper section 98 of the proppant hopper 12 may also include a permeability altering fluid addition port 102. A permeability altering fluid may be injected into the proppant hopper 12 through the permeability altering fluid addition port 102 to further assist the proppant perform a sealing function for the proppant hopper 12. The permeability altering fluid will preferably be a non-volatile fluid. The permeability altering fluid may include water, low vapor pressure hydrocarbons, and methanol/water mixtures.

The differential pressure across the hopper 12 will be the maximum vapor pressure of the fluid used at the highest potential ambient temperature. The ambient temperature will change from geographic location and time of year. The fracturing vapor outlet 26 functions to minimize the potential pressure drop across the proppant hopper 12 by reducing the pressure in the blender 14. This allows the flow of proppant through the hopper 12 to seal the hopper 12 against leakage of gases in the proppant transfer connection 18 and blender 14.

Inert gas may also be injected into the upper section 98 of the proppant hopper 12 through the upper inert gas injection port 100 to increase the pressure in the upper section 98 of the proppant hopper 12. The increased pressure in the upper section 98 of the proppant hopper 12 reduces the pressure drop across the proppant hopper 12. The reduced pressure drop across the proppant hopper 12 improves the efficiency of the seal created by the flow of proppant through the proppant hopper 12.

Once the minimum cross sectional area of the proppant flow has been determined for a given desired output from the blender 14, the variable proppant regulator 104 will preferably be adjusted to provide an orifice overlap between the regulating orifice 108 and the exit orifice 110 that provides an opening of the minimum cross sectional area. The use of the variable proppant regulator allows the proppant hopper 12 to be used with many various proppant flows.

The blender 14 may be a centrifugal type blender, a barrel type blender, or any other type of blender known in the art. Fracturing fluid enters the blender 14 through the fracturing fluid supply connection 20. The optional additive enters the blender 14 through the additive inlet 30. The fracturing vapor outlet 26 allows any particles, vapors or gases within the blender 14 to be transferred away from the blender 14. Once the proppant, the fracturing fluid, and the optional additives are mixed in the blender 14 they are transmitted from the blender 14 through the outlet 40 of the blender 14

A number of embodiments of the present invention have been described. Nevertheless, it will be understood that various modifications may be made without departing from the spirit and scope of the invention. Accordingly, other embodiments are within the scope of the following claims.

What is claimed is:

1. An environmentally sealed apparatus for fracturing subterranean systems, comprising:

an environmentally sealed proppant hopper comprising a variable proppant regulator;

an environmentally sealed blender comprising a blender inlet and a blender outlet;

a high pressure pump comprising a high pressure pump inlet and a high pressure pump outlet;

said blender inlet comprising a fracturing fluid inlet, a fracturing vapor outlet, and a proppant inlet;

said environmentally sealed proppant hopper connected to said blender inlet through a proppant transfer connection; and said blender outlet fluidically connected to said high pressure pump inlet.

2. The environmentally sealed apparatus for fracturing subterranean systems of claim 1, wherein said blender inlet further comprises an additive inlet.

3. The environmentally sealed apparatus for fracturing subterranean systems of claim 1, wherein the environmentally sealed proppant hopper further comprises a hopper seal.

4. The environmentally sealed apparatus for fracturing subterranean systems of claim 1, further comprising:

an environmentally sealed proppant conveyance system connected to said environmentally sealed proppant hopper.

5. The environmentally sealed apparatus for fracturing subterranean systems of claim 4, wherein said sealed proppant conveyance system comprises a proppant lifting auger.

6. The environmentally sealed apparatus for fracturing subterranean systems of claim 4, wherein said sealed proppant conveyance system comprises at least one purging gas inlet.

7. The environmentally sealed apparatus for fracturing subterranean systems of claim 4, further comprising:

an environmentally sealed proppant storage tank connected to said environmentally sealed proppant conveyance system.

8. The environmentally sealed apparatus for fracturing subterranean systems of claim 7, further comprising:

an environmentally sealed fracturing fluid storage tank connected to said fracturing fluid inlet and said fracturing vapor outlet.

9. The environmentally sealed apparatus for fracturing subterranean systems of claim 8, further comprising:

an environmentally sealed additive storage tank connected to said additive inlet.

10. The environmentally sealed apparatus for fracturing subterranean systems of claim 8, wherein said environmentally sealed fracturing fluid storage tank is connected to an inlet manifold.

11. The environmentally sealed apparatus for fracturing subterranean systems of claim 10, wherein said environmentally sealed fracturing fluid storage tank is connected to a vent manifold.

12. An environmentally sealed system for fracturing subterranean systems, comprising:

an environmentally sealed fracturing fluid source;

an environmentally sealed proppant source;

an environmentally sealed proppant hopper comprising a variable proppant regulator;

an environmentally sealed blender comprising a blender inlet and a blender outlet;

a high pressure pump comprising a high pressure pump inlet and a high pressure pump outlet;

a well head;

said environmentally sealed fracturing fluid source fluidically connected to said blender inlet through a fracturing fluid supply connection and a fracturing vapor recovery connection;

said environmentally sealed proppant source connected in a flow relationship with said environmentally sealed proppant hopper through a proppant supply connection and a proppant vapor recovery connection;

said environmentally sealed proppant hopper connected to said blender inlet through a proppant transfer connection;

said blender outlet fluidically connected to said high pressure pump inlet; and said high pressure pump outlet fluidically connected to said well head.

13. The environmentally sealed system for fracturing subterranean systems of claim 12, further comprising:

an environmentally sealed additive source fluidically connected to said blender inlet.

14. The environmentally sealed system for fracturing subterranean systems of claim 12, wherein the environmentally sealed proppant hopper further comprises a hopper seal.

15. The environmentally sealed system for fracturing subterranean systems of claim 12, further comprising:

an environmentally sealed additive storage supply; and said additive storage supply fluidically connected to said blender inlet.

16. The environmentally sealed system for fracturing subterranean systems of claim 12, further comprising:

an environmentally sealed proppant conveyance system.

17. The environmentally sealed system for fracturing subterranean systems of claim 16, wherein said sealed proppant conveyance system comprises a proppant lifting auger.

18. The environmentally sealed system for fracturing subterranean systems of claim 16, wherein said sealed proppant conveyance system comprises at least one purging gas inlet.

19. The environmentally sealed system for fracturing subterranean systems of claim 16, wherein the environmentally sealed proppant hopper further comprises a permeability altering fluid addition port.

* * * * *